United States Patent [19]

Chiariello et al.

[11] 4,410,093

[45] Oct. 18, 1983

[54] DEVICE FOR ORGANIZING PAPERS AND FILES

[75] Inventors: Dan Chiariello; Ned Chiariello, both of Burlington, Wis.

[73] Assignee: Keystone Ferrule & Nut Corporation, Burlington, Wis.

[21] Appl. No.: 264,579

[22] Filed: May 18, 1981

[51] Int. Cl.[3] ..... B42F 17/00

[52] U.S. Cl. ..... 211/11; 211/184; 211/189; 403/292

[58] Field of Search ..... 211/11, 43, 184, 189, 211/175; 248/346; 403/292, 298; 108/64, 90; 312/111, 183; 297/248; 46/1 K, 31, 36

[56] References Cited

U.S. PATENT DOCUMENTS

| | | | |
|---|---|---|---|
| 423,647 | 3/1890 | Wells | 211/11 |
| 451,729 | 5/1891 | Dom | 211/11 |
| 1,257,528 | 2/1918 | Plank | 211/11 |
| 1,750,575 | 3/1930 | Cobberley | 211/11 |
| 2,062,802 | 1/1936 | Walker | 211/11 X |
| 2,121,190 | 6/1938 | Fellowes | 312/111 X |
| 2,582,553 | 12/1952 | McMurtrie | 46/26 |
| 3,246,433 | 4/1966 | Eriksson | 403/292 X |
| 3,712,540 | 1/1973 | Yamasaki et al. | 46/26 X |
| 3,752,553 | 8/1973 | Bildahl et al. | 312/111 X |
| 3,760,744 | 9/1973 | Cruckshank | 108/64 |

*Primary Examiner*—James T. McCall
*Assistant Examiner*—David L. Talbott
*Attorney, Agent, or Firm*—Wallenstein, Wagner, Hattis, Strampel & Aubel

[57] ABSTRACT

A device for use as a desk organizer which can be compactly packaged and easily shipped in a knockdown condition, and, which, at the point of use, can be readily assembled without the need for any type of tool. The device comprises a base member, removable end members and a plurality of dividers which can be selectively positioned on the base member. The device further comprises a connector for enabling two of the base members to be interconnected thereby permitting a user to easily double the paper and file holding capacity of the device. Additional connectors can be employed, if desired, to further increase the capacity of the device.

16 Claims, 6 Drawing Figures

Fig 1
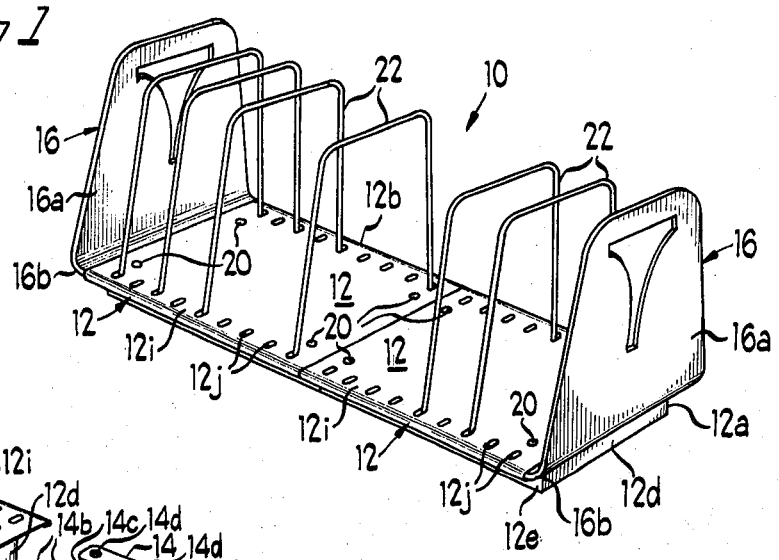
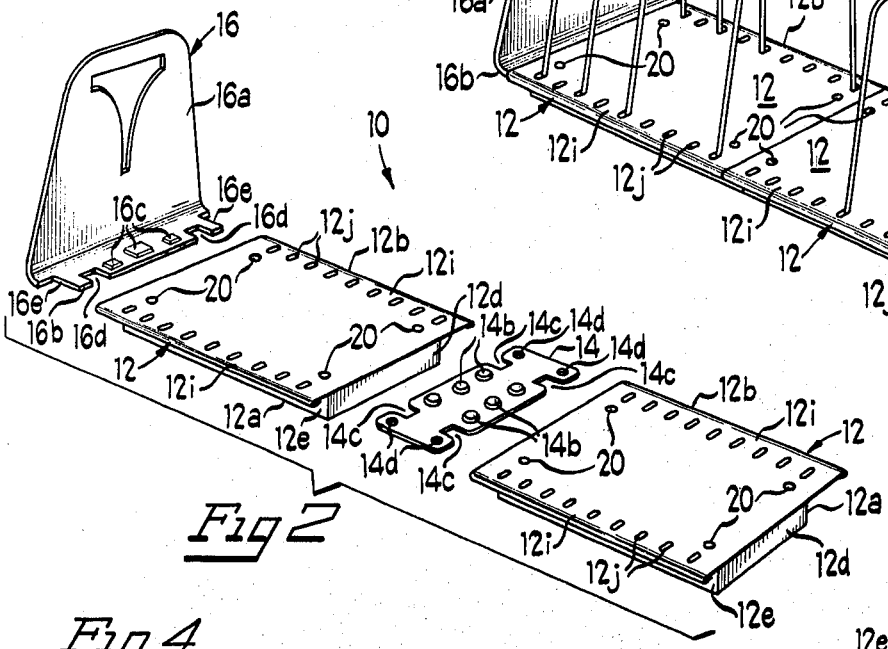
Fig 2
Fig 3
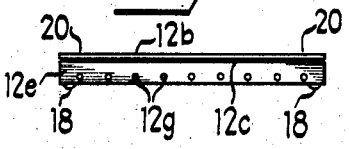
Fig 4
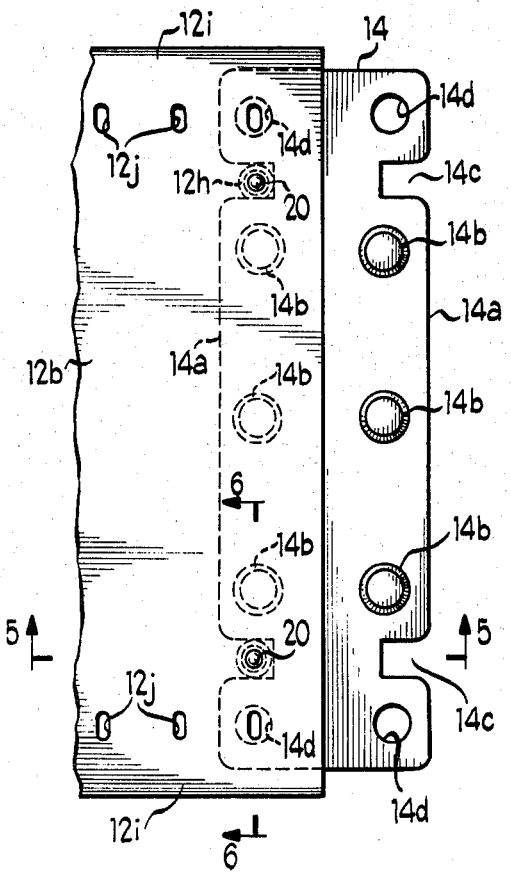
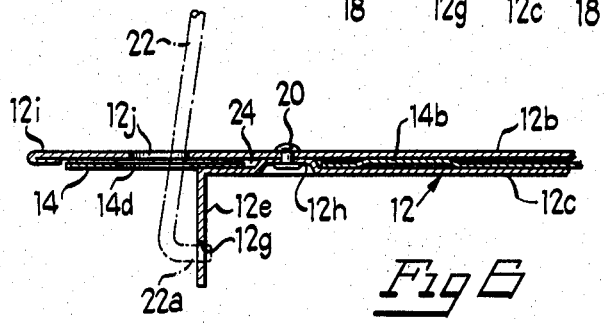
Fig 6
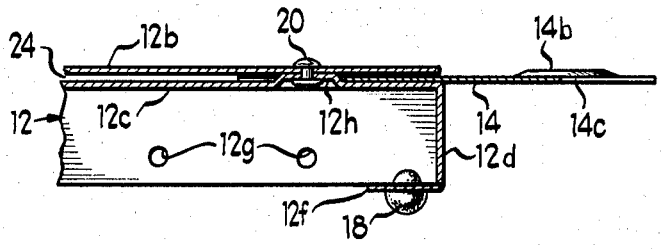
Fig 5

DEVICE FOR ORGANIZING PAPERS AND FILES

The present invention relates to a knockdown extendible device adapted for use on a desk top, table top, or the like supporting surface, for holding files, folders, papers, ledgers, and the like, in an organized, uncluttered and readily accessible condition.

Heretofore, knockdown-type desk organizers, or file racks, have taken the form of a wooden or metal base provided with means such as recesses, notches, slots, or the like, for receiving the in-turned ends of wire dividers to be supported on the base. Exemplary of such prior units are those disclosed in U.S. Pat. Nos. 451,729, 1,257,528 and 2,062,802. While the wire dividers employed with such units can be positioned on the base at any desired distance apart within the dimensional limits of the base, no provision is made for extending the length of the base by interconnecting it to another unit, for example, for the purpose of accommodating a greater number of articles. In U.S. Pat. No. 1,750,575, interconnectible, L-shaped, book end-like desk units are shown which employ a series of corrugations in the horizontal portion of each unit to enable two, or more, of the units to be attached in overlying relation to one another. Wholly apart from the cumbersomeness, and the unattractive appearance of the units of the patent, the overlapping arrangement used to attach one unit to another wastes storage space and limits the extent to which the vertical, article separating portions of each unit can be spaced from each other.

In accordance with the present invention, a knockdown device for holding articles such as files, folders, papers, ledgers, and the like, is provided which not only is extendible, but, also, enables a user to engage article separating means on the device at any desired position. In addition to its functional versatility, the device can be packaged and shipped in a compact, disassembled condition, and, at its point of use, can be quickly and easily assembled without the need for any kind of a tool. The device is rugged in construction while being highly attractive in appearance. It can hold substantially any size folder, file, paper, or ledger, and requires minimal space on a desk top, or the like supporting surface.

The device, in brief, comprises a base member having a lower, supporting surface engaging portion, and an upper article supporting portion. The upper and lower portions of the base member are positioned in vertically spaced relation to one another, and the upper portion has a plurality of longitudinally spaced openings or slots formed along the side margins thereof through which the ends of wire dividers included with the device extend. The ends of the wire dividers are in-turned and are adapted to be engaged in openings provided along the side walls of the base member. Removable end members are provided for each end of the base member. Unique connector means is included with the device for enabling two base members to be interconnected in end-to-end relation. Additional connector means can be provided, if desired, permitting more than two base members to be so joined. The removable end members and the connector means are adapted to be snugly frictionally engaged in the space between the upper and lower portions of the base member. Cooperating stop means for limiting the extent to which the end members and the connector means can be inserted between said portions of the base member advantageously is provided on the base member and the margins of the end members and the connector means. When inter-engaged the various elements comprising the device form a stable, unitary structure which can be moved, as a unit, to any desired location.

The foregoing, and other advantages and features of the invention will become clear to those skilled in the art upon reference to the following specification, the claims, and the accompanying drawings wherein:

FIG. 1 is a view in perspective of an embodiment of the device of the present invention illustrating two base members interconnected;

FIG. 2 is an exploded view in perspective of the base members, and end member, and a connector for forming the embodiment shown in FIG. 1;

FIG. 3 is a side view in elevation of one of the base members of the embodiment shown in FIGS. 1 and 2;

FIG. 4 is an enlarged fragmentary plan view showing the connector engaged on an end of a base member of said embodiment;

FIG. 5 is a sectional view taken substantially along line 5—5 of FIG. 4, and showing a divider in position on the base member; and FIG. 6 is a sectional view taken substantially along line 6—6 of FIG. 4.

Referring, now, in more detail to FIGS. 1 and 2 of the drawings, the embodiment of the device illustrated, and designated generally by reference numeral 10, comprises a pair of base members 12-12 interconnected by a connector 14, and having end members 16-16 engaged on the ends thereof. In accordance with another aspect of the invention, the device may comprise a single base member and a pair of removable end members. The connector, in this form of the invention, would then provide a convenient and effective means for adding a second base member to the original one.

Each base member 12 has a lower, supporting surface engaging portion **12*a* and an upper, article supporting portion 12*b*. The lower portion 12*a* has a top wall 12*c*, and depending end walls 12*d*-12*d* and side walls 12*e*-12*e*. The end walls 12*d*-12*d* are each provided with a pair of inwardly extending ears 12*f*-12*f* having openings therethrough for receiving and retaining feet 18 made of rubber or the like. The side walls 12*e*-12*e* of the base members have a plurality of spaced openings 12*g* formed therethrough, the function of which will become clear as the description proceeds. The top wall 12*c* of each base member 12 has two rounded extensions or bosses 12*h*-12*h* formed therein at each end adjacent to the corners thereof. The bosses 12*h*-12*h* serve to maintain the upper portion 12*b* and the top wall 12*c* of the base members in slightly, vertically spaced relation to one another. The upper portion 12*b* is secured to the lower portion 12*a* by pin-like members or rivets 20 which pass through the bosses 12*h*-12*h* in the top wall 12*c* of the lower portion 12*a***.

The upper portion **12*b* of each base member 12 comprises a flat panel or plate, the side margins 12*i*-12*i* of which extend outwardly with relation to the side walls 12*e*-12*e* of the lower portion 12*a* of the base members. The outwardly extending side margins 12*i*-12*i* each has a plurality of longitudinally spaced openings or slots 12*j* formed therein through which the ends 22*a* of a plurality of wire dividers 22 are intended to pass. As best shown in FIG. 5, the ends 22*a* of the dividers 22 are in-turned and are adapted to be engaged in an opening 12*g* in the side walls 12*e*-12*e* of the lower portion 12*a* of each base member 12**.

The connector 14 of the device comprises a relatively narrow symmetrical plate each of the longitudinal or side margins 14*a*-14*a* of which has a plurality of rounded extensions or bosses 14*b* formed therein. The side margins 14*a*-14*a* also are provided with a pair of spaced recesses or notches 14*c*-14*c*, and the ends of the connector 14 each has a pair of spaced openings 14*d*-14*d* therethrough. As best illustrated in FIGS. 4, 5 and 6, the side margins 14*a*-14*a* of the connector 14 are adapted to be inserted in the narrow space 24 between the upper portion 12*b* and the top wall 12*c* of the lower portion 12*a* of each base member 12. The bosses 14*b* formed along the margins 14*a*-14*a* of the connector 14 make snug frictional contact with the inner surface of the upper portion 12*b* and serve to maintain the connector 14 in position on the base members 12. The recesses 14*c*-14*c* in each of the margins 14*a*-14*a* receive the bosses 12*h*-12*h* formed in the top wall 12*c* of the lower portion 12*a* of each base member, and, together with the bosses 12*h*-12*h*, form cooperating stop means for limiting the extent to which the margins 14*a*-14*a* of the connector 14 can be inserted into the space 24, and, in addition, act to limit any transverse movement of the base member with relation to the connector 14. When the base members 12 are joined end-to-end by the connector 14 as shown in FIG. 1, the opening 14*d* in the ends of the connected are in register with the last slots 12*j* adjacent to the inner edge of the upper portion 12*b* of each of the members 12 (see FIG. 4). This arrangement enables all of the slots 12*j* in the upper portion 12*b* to be used for receiving and positioning dividers 22 a desired distance from each other.

The removable end members 16-16 of the device, as illustrated, each comprise an upwardly extending portion 16*a* and an inwardly extending portion 16*b*. The shape and dimensions of the portion 16*a*, of course, can be varied as desired. The portion 16*b* of each end member 16 has a plurality of rectangularly shaped extensions or bosses 16*c* formed along the inner edge thereof, and is provided with a pair of spaced notches or recesses 16*d*-16*d*. The ends of the portion 16*b* are notched or recessed to provide clearance space 16*e* for the outer corners of the upper portion 12*b* of each base member 12 when the end members 16-16 are in position.

The end members 16-16 are secured on the base members 12 by inserting the inwardly extending portion 16*b* of each end member into the space 24 between the top wall 12*c* of the lower portion 12*a*, and the upper portion 12*b*, of the base members. The bosses 16*c* on the portion 16*b* snugly frictionally engage the inner surface of the upper portion 12*b*, and the recesses 16*d*-16*d* receive and engage the bosses 12*h* formed on the top wall 12*c* of the lower portion 12*a* of the base member 12. The recesses 16*d*-16*d* and the bosses 12*h*-12*h* cooperate to limit the extent to which the portion 16*b* of the end members 16-16 can be inserted into the space 24, and, in addition, act to limit any transverse movement of the end member in relation to the base member.

In its assembled condition, as illustrated in FIG. 1, the device has the appearance and structural characteristics of a one piece unit, and can be moved as a unit to any desired location, even with articles such as files, folders, and the like positioned between the dividers 22. As indicated hereinabove, a third, or even a fourth, base member may be interconnected at either or both ends of the device as shown in FIG. 1. This can be accomplished by simply removing one or both of the end members 16-16, and inserting another connector on the base members 12. The added base member, or members, can then be attached by inserting the exposed margin of the connectors in the base members as described above. After the added base member, or members, have been joined in end-to-end relation with the first two base members, the end members can be repositioned thereon.

While the invention has been described in relation to a preferred embodiment thereof, it should be understood that various modifications may be made therein by those skilled in the art without departing from the spirit and scope of the invention.

What is claimed is:

1. A device for supporting articles such as files, folders, envelopes, papers, or the like, on a desk top, table top, or the like supporting surface, comprising: a base member adapted to be positioned on a supporting surface, said base member including a lower, supporting surface engaging portion and an upper, article supporting portion having side margins which extend outwardly with relation to the corresponding margins of the supporting surfaces engaging portion, said side margins being provided with a plurality of aligned, longitudinally spaced openings, said portions of the base member being positioned in vertically spaced relation to one another; a plurality of article support members adapted to be releasably engaged in the openings provided in the side margins of the article supporting portion of the base member for receiving therebetween articles to be supported on the device; at least one removable end member for engagement on the base member, said end member having an upwardly extending article supporting portion and an inwardly extending base member engaging portion adapted to be received in the space between said portions of the base member; and stop means on the base member for limiting the extent to which the inwardly extending base member engaging portion of said at least one removable end member can be inserted between said portions of the base member.

2. A device according to claim 1 wherein the lower, supporting surface engaging portion of the base member is provided with a plurality of spaced extensions which act to maintain the upper, article supporting portion of the base member in vertically spaced relation to the lower, supporting surface engaging portion thereof.

3. A device according to claim 1 wherein the inwardly extending base member engaging portion of said at least one removable end member is provided with a plurality of extensions which engage the upper, article supporting portion of the base member and serve to snugly frictionally maintain the inwardly extending base member engaging portion in the space between the upper and lower portions of the base member.

4. A device according to claim 1 wherein the upper and lower portions of the base member are attached to one another by spaced pin-like members.

5. A device according to claim 3 wherein the inwardly extending base member engaging portion of said at least one removable end member is provided with a plurality of recesses in the leading edge thereof for receiving the spaced extensions on the base member.

6. A device according to claim 1 wherein connector means is provided for the base member to enable a second base member to be releasably interconnected therewith.

7. A device according to claim 6 wherein the connector means comprises an elongated plate member, the longitudinal margins of which are adapted to be received in the space between the upper and lower portions of the interconnected base members.

8. A device according to claim 7 wherein the plate member is provided with a plurality of extensions along the longitudinal margins thereof, said extensions serving to snugly frictionally maintain said margins of the plate member between the upper and lower portions of the interconnected base members.

9. A device according to claim 7 wherein each of the longitudinal margins of the plate member are provided with stop means for limiting the extent to which said margins can be inserted between the upper and lower portions of the interconnected base members.

10. A device according to claim 7 wherein the plate member is provided with openings at the ends thereof which are in register with the openings in the upper portion of each of the base members.

11. A device according to claim 9 wherein the stop means comprises recesses in the longitudinal margins of the plate member for receiving spaced extensions formed in the lower portion of the base member.

12. A device for supporting articles such as files, folders, envelopes, papers, or the like, on a desk top, table top, or the like supporting surface, comprising: a pair of base members adapted to be positioned on a supporting surface, said base members each including a lower, supporting surface engaging portion and an upper, article supporting portion, said portions of the base members being positioned in vertically spaced relation to one another, said article supporting portion of each base member having side margins which extend outwardly with relation to the corresponding margins of the supporting surface engaging portion, said side margins being provided with a plurality of aligned, longitudinally spaced openings; a plurality of article support members adapted to be releasably engaged in the openings provided in the side margins of the article supporting portion of each base member for receiving therebetween articles to be supported on the device; and connector means for releasably interconnecting the base members in end-to-end relation to one another, said connector means having side margins adapted to be inserted in the space between the upper and lower portions of each base member at one end thereof, the side margins of the connector means having anchoring means for snugly frictionally maintaining the base members in their releasably interconnected end-to-end relation.

13. A device according to claim 12 wherein the connector means comprises an elongated plate member having extensions formed therein along its longitudinal margins, said extensions serving to snugly frictionally maintain the base members in end-to-end relation.

14. A device according to claim 12 wherein the upper and lower portions of each base member are secured in fixed, vertically spaced relation to one another by pin-like members.

15. A device according to claim 12 wherein the lower portion has extensions formed therein which engage the inner surface of the upper portion and maintain it in vertically spaced relation to the lower portion.

16. A device according to claim 15 wherein the side margins of the connector means are provided with recesses for receiving the extensions formed in the lower portions of the base members, said recesses and extensions cooperating to act as stop means for limiting the extent the connector means can be inserted between the upper and lower portions of the base members.

* * * * *